US007275276B2

(12) United States Patent
Jaszenovics et al.

(10) Patent No.: US 7,275,276 B2
(45) **Date of Patent: *Oct. 2, 2007**

(54) CLEANING HEAD

(75) Inventors: Agnes Jaszenovics, Oakland, CA (US); Douglas J. Minkler, Oakland, CA (US); Kaitlin Roach, Oakland, CA (US)

(73) Assignee: The Clorox Company, Oakland, CA (US)

( * ) Notice: Subject to any disclaimer, the term of this patent is extended or adjusted under 35 U.S.C. 154(b) by 128 days.

This patent is subject to a terminal disclaimer.

(21) Appl. No.: 11/064,864

(22) Filed: Feb. 23, 2005

(65) Prior Publication Data

US 2005/0138742 A1 Jun. 30, 2005

Related U.S. Application Data

(63) Continuation-in-part of application No. 10/663,496, filed on Sep. 12, 2003, now Pat. No. 7,127,768.

(51) Int. Cl.
*A47K 11/10* (2006.01)
*A47L 13/16* (2006.01)

(52) U.S. Cl. ..... 15/104.94; 15/209.1; 15/210.1; 15/244.1; 15/244.3

(58) Field of Classification Search ..... 15/104.94, 15/209.1, 210.1, 229.11, 229.13, 244.1, 244.3
See application file for complete search history.

(56) References Cited

U.S. PATENT DOCUMENTS

| | | | | |
|---|---|---|---|---|
| 1,994,939 | A * | 3/1935 | Boulton | 15/121 |
| 2,221,128 | A | 11/1940 | Bates | 15/244.1 |
| 3,383,158 | A | 5/1968 | Leland | 401/201 |
| 3,413,673 | A | 12/1968 | Gewirz | 15/105 |
| 3,645,821 | A * | 2/1972 | Baumann et al. | 156/196 |
| 3,737,939 | A * | 6/1973 | Jones, Sr. | 15/244.2 |
| 3,753,267 | A * | 8/1973 | Johnson, Sr. | 15/210.1 |
| 4,031,673 | A | 6/1977 | Hagelberg | 51/385 |
| 4,523,347 | A | 6/1985 | Tames | 15/104.94 |
| 4,793,019 | A * | 12/1988 | Stima et al. | 15/104.94 |
| 4,852,201 | A | 8/1989 | Wundrock et al. | 15/145 |
| 4,970,750 | A * | 11/1990 | Davis, III | 15/244.1 |
| 5,003,659 | A | 4/1991 | Paepke | 15/209 |
| 5,038,233 | A * | 8/1991 | Inoue | 360/75 |
| 5,058,233 | A * | 10/1991 | Davis, III | 15/244.1 |
| 5,140,717 | A | 8/1992 | Castagliola | 15/209.1 |
| 5,419,015 | A | 5/1995 | Garcia | 15/228 |
| 5,862,565 | A | 1/1999 | Lundstedt | 15/220.1 |
| 6,044,515 | A * | 4/2000 | Zygmont | 15/209.1 |
| 6,094,771 | A | 8/2000 | Egolf et al. | 15/210.1 |
| 6,290,781 | B1 | 9/2001 | Brouillet, Jr. | 134/7 |
| 6,485,212 | B1 | 11/2002 | Bomgaars et al. | 401/11 |
| 6,611,986 | B1 | 9/2003 | Seals | 15/210.1 |
| 2002/0007527 | A1 | 1/2002 | Hart | 15/104.94 |

FOREIGN PATENT DOCUMENTS

| | | |
|---|---|---|
| JP | 2000-308600 | * 11/2000 |

* cited by examiner

*Primary Examiner*—Mark Spisich
(74) *Attorney, Agent, or Firm*—David Peterson

(57) ABSTRACT

A cleaning head with a cleaning substrate, a cleaning composition and a fitment can used to clean hard surfaces, including toilets, showers, and bathrooms. The fitment can be attached to a cleaning tool. The cleaning face of the cleaning substrate can be in the shape of a polygon. The fitment can be attached to the cleaning substrate by melting the fitment above its softening temperature.

17 Claims, 1 Drawing Sheet

CLEANING HEAD

CROSS REFERENCE TO RELATED APPLICATION

The present application is a continuation-in-part of Co-pending application Ser. No. 10/663,496 to Blum et al., which was filed Sep. 12, 2003 now U.S. Pat. No. 7,127,768, entitled "Disposable Cleaning Head", and incorporated herein.

BACKGROUND OF THE INVENTION

1. Field of the Invention

The present invention relates generally to a cleaning heads with an attached fitment for attaching to a cleaning implement. The fitment may allow for rotational attachment of the cleaning head to the cleaning implement. The cleaning head contains a cleaning substrate that may additionally contain cleaning compositions, and optionally may contain an antimicrobial agent. The cleaning substrate may have a cleaning surface in the shape of a polygon, for example, a hexagon. The invention also relates to a method for cleaning toilets, bathrooms, showers, bathtubs and the like.

2. Description of the Related Art

Numerous types of cleaning compositions, as well as holders for disposable cleaning pads, are known in the art. Illustrative are the compositions and apparatus disclosed in U.S. Pat. No. 4,852,201, U.S. Pat. No. 4,523,347, U.S. Pat. No. 4,031,673, U.S. Pat. No. 3,413,673 and U.S. Pat. No. 3,383,158.

U.S. Pat. No. 4,852,201 to Wundrock et al. discloses a toilet bowl cleaner having a handle with a removable cleaning pad disposed on one end. The toilet bowl cleaner also includes a cleaning solution that is contained in the pad.

U.S. Pat. No. 2,221,128 to Bates discloses a bathing brush with an octagonal sponge with an attached fitment that allows insertion of a handle.

It is therefore an object of the present invention to provide a cleaning head with a cleaning substrate and attached fitment that overcomes the disadvantages and shortcomings associated with prior art cleaning heads for cleaning hard surfaces.

SUMMARY OF THE INVENTION

In accordance with the above objects and those that will be mentioned and will become apparent below, one aspect of the present invention comprises a cleaning head comprising:

a. a cleaning substrate;
b. a cleaning composition impregnated in said cleaning substrate; and
c. a fitment attached to said cleaning substrate;
d. wherein said cleaning substrate has a cleaning face in the shape of a regular polygon; and
e. wherein said fitment is attached to said cleaning substrate by heating said fitment above its softening temperature and pressing said fitment against said cleaning substrate.

In accordance with the above objects and those that will be mentioned and will become apparent below, another aspect of the present invention comprises a cleaning head comprising:

a. a cleaning substrate;
b. a cleaning composition impregnated in said cleaning substrate; and
c. a fitment attached to said cleaning substrate, d. wherein said cleaning substrate has a cleaning face in the shape of a regular polygon.

In accordance with the above objects and those that will be mentioned and will become apparent below, another aspect of the present invention comprises a cleaning head comprising:

a. a cleaning substrate;
b. a cleaning composition impregnated in said cleaning substrate; and
c. a fitment attached to said cleaning substrate,
d. wherein said fitment is attached to said cleaning substrate by heating said fitment above its softening temperature and pressing said fitment against said cleaning substrate.

Further features and advantages of the present invention will become apparent to those of ordinary skill in the art in view of the detailed description of preferred embodiments below, when considered together with the attached claims.

BRIEF DESCRIPTION OF THE DRAWINGS

Further features and advantages will become apparent from the following and more particular description of embodiments of the invention, as illustrated in the accompanying drawings, and in which like referenced characters generally refer to the same parts or elements throughout the views, and in which.

DETAILED DESCRIPTION OF THE INVENTION

Figure 1:
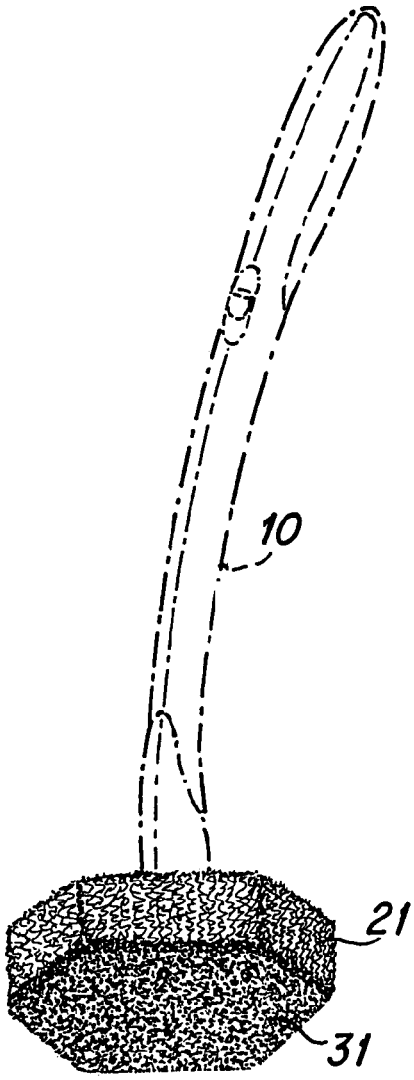
FIG. 1 is a perspective view of one embodiment of the cleaning head operatively attached to a cleaning tool, according to the invention.

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

The cleaning substrate can be used as a disinfectant, sanitizer, and/or sterilizer. As used herein, the term "disinfect" shall mean the elimination of many or all pathogenic microorganisms on surfaces with the exception of bacterial endospores. As used herein, the term "sanitize" shall mean the reduction of contaminants in the inanimate environment to levels considered safe according to public health ordinance, or that reduces the bacterial population by significant numbers where public health requirements have not been established. An at least 99% reduction in bacterial population within a 24 hour time period is deemed "significant." As used herein, the term "sterilize" shall mean the complete elimination or destruction of all forms of microbial life and which is authorized under the applicable regulatory laws to make legal claims as a "Sterilant" or to have sterilizing properties or qualities.

In the application, effective amounts are generally those amounts listed as the ranges or levels of ingredients in the descriptions, which follow hereto. Unless otherwise stated, amounts listed in percentage ("%'s") are in weight percent (based on 100% active) of the cleaning composition alone, not accounting for the substrate weight. Each of the noted cleaner composition components and substrates is discussed in detail below.

As used herein, the term "substrate" is intended to include any material that is used to clean an article or a surface. Examples of cleaning substrates include, but are not limited to nonwovens, sponges, films and similar materials which can be attached to a cleaning implement, such as a floor mop, handle, or a hand held cleaning tool, such as a toilet cleaning device. As used herein, "disposable" is used in its ordinary sense to mean an article that is disposed or discarded after a limited number of usage events, preferably less than 25, more preferably less than about 10, and most preferably less than about 2 entire usage events.

As used herein, "wiping" refers to any shearing action that the substrate undergoes while in contact with a target surface. This includes hand or body motion, substrate-implement motion over a surface, or any perturbation of the substrate via energy sources such as ultrasound, mechanical vibration, electromagnetism, and so forth.

As used herein, the terms "nonwoven" or "nonwoven web" means a web having a structure of individual fibers or threads which are interlaid, but not in an identifiable manner as in a knitted web. Nonwoven webs have been formed from many processes, such as, for example, meltblowing processes, spunbonding processes, and bonded carded web processes.

As used herein, the term "polymer" generally includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

The term "sponge", as used herein, is meant to mean an elastic, porous material, including, but not limited to, compressed sponges, cellulosic sponges, reconstituted cellulosic sponges, cellulosic materials, foams from high internal phase emulsions, such as those disclosed in U.S. Pat. No. 6,525,106, polyethylene, polypropylene, polyvinyl alcohol, polyurethane, polyether, and polyester sponges, foams and nonwoven materials, and mixtures thereof.

The term "cleaning composition", as used herein, is meant to mean and include a cleaning formulation having at least one surfactant.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, nonionic and/or amphoteric agents.

Cleaning Implement

In an embodiment of the invention, the cleaning implement comprises the tool assembly disclosed in Co-pending application Ser. No. 10/678033, entitled "Cleaning Tool with Gripping Assembly for a Disposable Scrubbing Head", filed Sep. 30, 2003.

In another embodiment of the invention, the cleaning implement comprises the tool assembly disclosed in Co-pending application Ser. No. 10/602478, entitled "Cleaning Tool with Gripping Assembly for a Disposable Scrubbing Head", filed Jun. 23, 2003 and published as U.S. Pat. App. 2004/0255418.

In another embodiment of the invention, the cleaning implement comprises the tool assembly disclosed in Co-pending application Ser. No. 10/766179, entitled "Interchangeable Tool Heads", filed Jan. 27, 2004 and published as U.S. Pat. App. 2004/0184867.

In another embodiment of the invention, the cleaning implement comprises the tool assembly disclosed in Co-pending application Ser. No. 10/817606, entitled "Ergonomic Cleaning Pad", filed Apr. 1, 2004.

In another embodiment of the invention, the cleaning implement comprises the tool assembly disclosed in Co-pending application Ser. No. 10/850213, entitled "Locking, Segmented Cleaning Implement Handle", filed May 19, 2004.

In another embodiment of the invention, the cleaning head and composition is described in Co-pending application Ser. No. 11/014426 to Adair et al., entitled "Antimicrobial Composition for Cleaning Substrate", filed Dec. 15, 2004.

In another embodiment of the invention, the cleaning implement comprises an elongated shaft having a handle portion on one end thereof. The tool assembly may further include a gripping mechanism that is mounted to the shaft to engage the removable cleaning substrate. One embodiment of the invention is shown in FIG. 1, which shows the cleaning tool 10 attached to the cleaning head 21. Examples of suitable cleaning implements are found in U.S. Pat. No. 5,003,659 to Paepke; U.S. Pat. No. 6,485,212 to Bomgaars et al.; U.S. Pat. No. 5,862,565 to Lundstedt; U.S. Pat. No. 5,419,015 to Garcia; U.S. Pat. No. 5,140,717 to Castagliola; U.S. Pat. No. 6,611,986 to Seals; and U.S. Pat. No. 6,094,771 to Egolf et al. The cleaning implement may have a hook, hole, magnetic means, canister or other means to allow the cleaning implement to be conveniently stored when not in use.

Substrate Cleaning Face Shape

Figure 6:
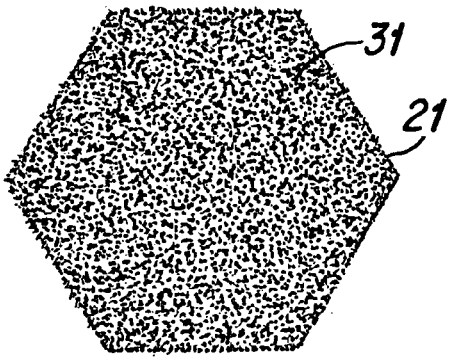
FIG. 6 is a bottom plane view of the cleaning head shown in FIG. 2.

The substrate cleaning face shape is the two-dimensional shape of the cleaning substrate face 31 where it impacts the cleaning surface, as shown in FIG. 6. For example, FIGS. 1 and 6 show a regular hexagon. These polygonal shapes, especially regular polygons, allow a pointed cleaning surface to be near the leading edge of the wiping motion when using the cleaning tool. A pointed cleaning surface may be advantegous for reaching into corners.

A suitable substrate cleaning face shape that is not a polygon is described in Co-pending application Ser. No. 10/817606, which was filed Apr. 1, 2004, entitled "Ergonomic Cleaning Pad", and incorporated herein. Suitable polygonal shapes include a heptagon, hexagon, pentagon, square, and triangle. These shapes are especially suitable where the cleaning substrate has an attached fitment that allows rotation relative to the plane of the cleaning surface of the cleaning substrate when attaching to a cleaning tool. Where the cleaning pad is a heptagon, the cleaning pad on the cleaning tool can be maneuvered to provide a point for cleaning at 51 degree intervals. Where the cleaning pad is a hexagon, the cleaning pad on the cleaning tool can be maneuvered to provide a point for cleaning at 60 degree intervals. Where the cleaning pad is a pentagon, the cleaning tool can be maneuvered to provide a point for cleaning at 72 degree intervals. Where the cleaning pad is a square, the cleaning tool can be maneuvered to provide a point for cleaning at 90 degree intervals. Where the cleaning pad is an equilateral triangle, the cleaning tool can be maneuvered to provide a point for cleaning at 120 degree intervals. Although all these shapes are suitable embodiments of the invention, for some purposes it may be desirable that the shape be a regular polygon, for instance, in order to obtain a consistent feel to the pad usage without regard to the orientation of the attached pad. Although all these shapes are suitable embodiments of the invention, for some purposes it may be desirable that a polygonal shape have a greater number of sides. For example, a randomly oriented hexagonal cleaning surface will more likely to have a pointed cleaning surface to be near the leading edge of the wiping motion when using the cleaning tool than a randomly oriented triangular cleaning surface.

Cleaning Substrate Fitment Attachment

The cleaning head 21 has a fitment 20 for attaching to a cleaning implement, as shown in FIGS. 2, 3, 4 and 5. Where the fitment is rod-like to allow for rotational attachment to the cleaning tool about an axis perpendicular to the plane of the cleaning substrate as FIGS. 2, 3, and 4, the fitment 20 can be attached to the cleaning tool 10 in any orientation of the cleaning head 21.

Figure 2:
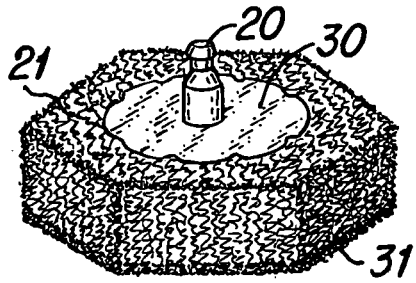
FIG. 2 is a perspective view of one embodiment of the cleaning head, according to the invention.
Figure 3:
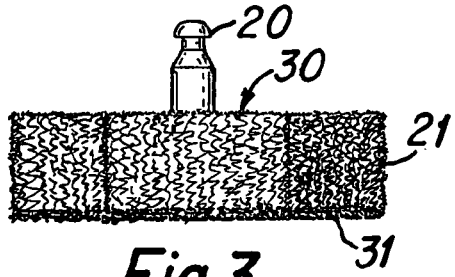
FIG. 3 is a front plane view of the cleaning head shown in FIG. 2.
Figure 4:
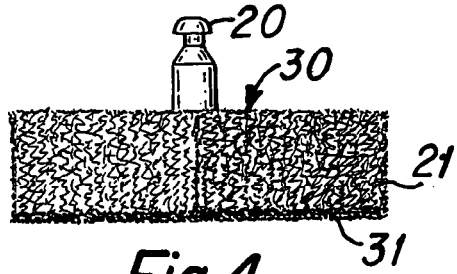
FIG. 4 is another front plane view of the cleaning head shown in FIG. 2.
Figure 5:
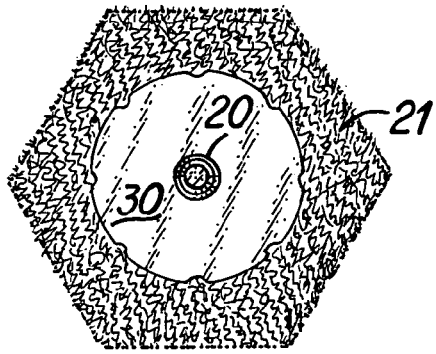
FIG. 5 is a top plane view of the cleaning head shown in FIG. 2.

The cleaning head may be attached by a friction fit means, by a clamping means, by a threaded screw means, by hook and loop attachment or by any other suitable attachment means. Suitable attachment structures are described in U.S. Pat. No. 4,852,201 to Wundrock et al., U.S. Pat. No. 5,471,697 to Daconta, U.S. Pat. No. 4,466,152 to Moss et al., U.S. Pat. No. 4,457,038 to Hammond, U.S. Pat. No. 4,642,836 to Bokmiller, and U.S. Pat. No. 6,154,913 to Burton. The cleaning substrate may have a rigid or flexible plastic or metal fitment for attachment to the cleaning tool. Where the fitment is a thermoplastic, for example polyethylene, or other material with a softening point, it may be partially softened and pressed onto the cleaning substrate to provide attachment to the cleaning substrate. FIGS. 2 and 5 show the cleaning head 21 with fitment 20 and fitment edge 30. Where the fitment has edges of 0.1 mm or less, the edges of the fitment can be softened without requiring softening of the entire fitment.

Cleaning Substrate

A wide variety of materials can be used as the cleaning substrate. The substrate should have sufficient wet strength, abrasivity, loft and porosity. Examples of suitable substrates include, nonwoven substrates, wovens substrates, hydroentangled substrates, foams and sponges. Any of these substrates may be water-insoluble, water-dispersible, or water-soluble. Suitable substrates are described in Co-pending application Ser. No. 10/882001, which was filed Jun. 29, 2004, entitled "Cleaning Pad with Functional Properties", and incorporated herein.

The cleaning substrate may be a single or dual density high-loft material, for example a polyester substrate. The substrate cleaning shape may be have an abrasive surface provided by various means, for example with an aluminosilicate/latex binder on the surface to provide scrubbiness. The cleaning substrate may be a single layer or multiple layers. In one embodiment, the substrate contains an absorbent layer. The thickness may be from 0.25 to 2 inches or about 1 inch.

The cleaning substrate can also consist entirely of a hydrophilic urethane foam or a suitable substrate coated with a hydrophilic urethane foam. The hydrophilic urethane foam contains agents or additives that are controllably released. Agents or additives can be from the group of, but not limited to, soaps, surfactants, detergents, disinfectants, antimicrobials, abrasives, polymers, waxes, polishes, shine agents, and phase change agents. The agents or additives can be incorporated as is or in encapsulated form directly into the matrix of the hydrophilic urethane foam. Suitable substrates can include nonwovens, wovens, foams, fabrics, textiles, and polymeric materials. The hydrophilic urethane can be coated, sprayed or applied by other appropriate means onto the substrate.

Hydrophilic urethane foams can be produced as described in U.S. Pat. Nos. 5,763,335; 5,976,616; 5,976,847; 6,025,287; 6,706,775; U.S. Pat. App. 2003/0207954; and U.S. Pat. App. 2003/0216483. The description includes a polymerization reaction between a hydrophilic urethane prepolymer and an aqueous formulation comprising agents, additives, superabsorbing polymer, and water.

The cleaning substrate can consist of a polyester nonwoven that is coated with a hydrophilic urethane foam composition. The hydrophilic urethane foam is formed by mixing a commercially available hydrophilic urethane prepolymer with an aqueous formulation comprising a quaternary ammonium chloride (such as Lonza 2250®), superabsorbing polymer, polyvinyl alcohol, nonionic surfactant, colorant, and water. A loading of 0.8 grams quaternary ammonium chloride onto the cleaning substrate resulted in greater than 200 ppm delivered to a toilet bowl containing 2800 ml water. Cleaning articles and attachments for use in other cleaning tasks can also utilize the controlled release feature of the hydrophilic urethane foam. These include, but are not limited to, a sponge or wipe with antimicrobial and disinfecting properties and a cleaning substrate for large area hard surfaces.

The cleaning substrate may be a laminate comprising an exterior scrubbing layer, a hydrophilic interior layer, and an attachment layer. The exterior scrubbing layer may be composed of 100% thermoplastic fibers, or may have minor amounts of other fibers.

The absorbent layer may be comprised of substrates with high holding capacity or large void space, for example, urethane foam, cellulose foam, melamine foam, airlaid pulp, needlepunched substrate, or through-air bonded substrate. The absorbent layer may be comprised of dense substrates with high capacities, for example, spunlace PET/pulp, spunlace PP/pulp, spunlace PE/pulp, spunbond PP, spunbond PET, spunbond bicomponent fiber, meltblown PP, meltblown PET, and SMS (spunbond/meltblown/spunbond).

The absorbent layer may also be a layer with controlled release, for example, formed films or substrates with gradient densities. Gradient density substrates can be formed from multiple layers ultrasonically or adhesively laminated together. These substrates could be formed using meltblown, spunbond, or SMS (spunbond/meltblown/spunbond). Formed films may be used with the cones pointing out in order to control the fluid rate in for dilution, and not the fluid flow out. An example of formed films is Tredegar formed films, described, for example, in U.S. App. 2004/0019340 to McBride and U.S. App. 2004/0002688 to Thomas et al. The films may also be needle-punched. Superabsorbent films containing polyethylene of other hydrophobic material would also allow controlled release.

The absorbent layer may also incorporate dissolvable films, such as PVA film. The PVA film may gradually dissolve to allow access to the cleaning composition. Multiple layers of PVA may allow release over time of subsequent cleaning compositions. The absorbent layer may also contain granules of slowly hydrating substances dispersed in a open structure, for example, an airlaid substrate. Slowly hydrating substances may be composed of superabsorbent polymer, starches, polypeptides, acrylates, gel-forming materials, or other such materials.

The hydrophilic interior layer may be entirely spunbond thermoplastic, for example polypropylene. An example of the hydrophilic interior layer and its properties is given in Table II. An interior layer of greater than three layers may have superior absorbent properties to an interior layer of the same basis weight with fewer layers. An interior layer of greater than five layers may have superior absorbent properties to an interior layer of the same basis weight with fewer layers.

The attachment layer may be comprised of a variety of fiber types, for example, polypropylene, polyethylene, polyester, bicomponent, or multicomponent fibers. The attachment layer may be formed from a variety of processes, for example, carded and thermal bond, carded and spray bond, needling, or a combination of these and other processes.

Cleaning Substrate Properties

The cleaning substrate may show minimal migration of the cleaning composition during storage. The cleaning substrate may comprise 100% thermoplastic fibers or 100% of the same thermoplastic fiber type in order to allow the more convenient bonding of layers. The cleaning substrate may also comprise some non-thermoplastic fibers, such as cellulosic fibers. The cleaning substrate should allow the cleaning composition to be used up after use on one to two tasks, for example one to two showers or toilets. One example of an indication of no more cleaning composition is the absence of foam. The cleaning substrate may change color as the soap is used up. The cleaning substrate may acquire a dirty appearance or may start to come apart in order to indicate that it should be disposed. The cleaning substrate should not be so thick that the consumer considers the pad not to be disposable. The cleaning substrate may allow any dye in the cleaning composition to be dispersed withing 30 seconds to indicate that the cleaning composition has been effectively delivered.

Cleaning Composition

In one embodiment, the cleaning substrate is impregnated with a cleaning composition and is 'wet-to-the-touch'. In another embodiment, the cleaning substrate is impregnated with a cleaning composition that is 'dry-to-the-touch'. By 'dry-to-the-touch', it is meant that the substrate is free of water or other solvents in an amount that would make them feel damp or wet-to-the-touch as compared to the touch of a wet substrate, for example a wet cleaning wipe.

Antimicrobial Agent

The cleaning composition may contain one or more antimicrobial agents. A wide range of quaternary compounds can be used as antimicrobial actives. Non-limiting examples of useful quaternary compounds include: (1) benzalkonium chlorides and/or substituted benzalkonium chlorides such as commercially available Barquat® (available from Lonza); (2) di(C6-C14)alkyl di short chain (C1-4 alkyl and/or hydroxyalkl) quaternary such as Bardac® products of Lonza, (3) N-(3-chloroallyl)hexaminium chlorides such as Dowicide® and Dowicil® available from Dow; (4) benzethonium chloride such as Hyamine® from Rohm & Haas; (5) methylbenzethonium chloride represented by Hyamine®10X supplied by Rohm & Haas, (6) cetylpyridinium chloride such as Cepacol chloride available from of Merrell Labs. Other useful cationic antimicrobial actives herein include biguanide compounds, either alone or in combination with other cationic antimicrobial actives. Suitable biguanide compounds include 1,1'-hexamethylene bis (5-(p-chlorophenyl)biguanide), commonly known as chlorhexidine, and its salts, e.g., with hydrochloric, acetic and gluconic acids. Other useful biguanide compounds include Cosmoci® CQ®, Vantocil®IB, including poly(hexamethylene biguanide) hydrochloride. Other useful antimicrobial agents include phenolic antibacterial agents, such as 2-hydroxydiphenyl compounds such as triclosan, available commercially under the tradename IRGASAN DP100, from Ciba Specialty Chemicals Corp., Greensboro, N.C. Another useful 2-hydroxydiphenyl compound is 2,2'-dihydroxy-5,5'-dibromodiphenyl ether. Additional bisphenolic compounds are disclosed in U.S. Pat. No. 6,113,933, incorporated herein by reference. Other phenolic antimicrobials include, but are not limited to, chlorophenols (o-, m-, p-), 2,4-dichlorophenol, p-nitrophenol, picric acid, xylenol, p-chloro-m-xylenol, cresols (o-, m-, p-), p-chloro-m-cresol, pyrocatechol, resorcinol, 4-n-hexylresorcinol, pyrogallol, phloroglucin, carvacrol, thymol, p-chlorothymol, o-phenylphenol, o-benzylphenol, p-chloro-o-benzylphenol, phenol, 4-ethylphenol, and 4-phenolsulfonic acid. Other phenol derivatives are listed in WO 98/55096 and U.S. Pat. No. 6,113,933, incorporated herein by reference.

Suitable concentrations of these antimicrobial agents in the chemical compositions range from about 0.5% to about 80%, or from about 10% to about 70%, or from about 20% to about 60%, or from about 40% to about 50%, by weight of the usage composition.

One benefit of the chemical compositions of the present invention, when no rinsing step is required or when the composition is not diluted into water, is residual antimicobial effect. By residual antimicrobial effect, it is meant that the residual antimicrobial actives delivered by chemical composition onto the hard surface are at least about 99.9% cidal against bacteria and other microorganisms for a period of from about 8 to about 72 hours.

Surfactants

The cleaning composition may contain one or more surfactants selected from anionic, nonionic, cationic, ampholytic, amphoteric and zwitterionic surfactants and mixtures thereof. A typical listing of anionic, nonionic, ampholytic, and zwitterionic classes, and species of these surfactants, is given in U.S. Pat. No. 3,929,678 to Laughlin and Heuring. A list of suitable cationic surfactants is given in U.S. Pat. No. 4,259,217 to Murphy. Where present, ampholytic, amphotenic and zwitteronic surfactants are generally used in combination with one or more anionic and/or nonionic surfactants. The surfactants may be present at a level of from about 0.1% to 50% by weight.

The cleaning composition may comprise an anionic surfactant. Essentially any anionic surfactants useful for detersive purposes can be comprised in the cleaning composition. These can include salts (including, for example, sodium, potassium, ammonium, and substituted ammonium salts such as mono-, di- and tri-ethanolamine salts) of the anionic sulfate, sulfonate, carboxylate and sarcosinate surfactants. Anionic surfactants may comprise a sulfonate or a sulfate surfactant. Anionic surfactants may comprise an alkyl sulfate, a linear or branched alkyl benzene sulfonate, or an alkyldiphenyloxide disulfonate, as described herein.

The cleaning composition may comprise one or more nonionic surfactants. Essentially any alkoxylated nonionic surfactants are suitable herein, for instance, ethoxylated and propoxylated nonionic surfactants. Alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Also suitable are the condensation products of alcohols having an alkyl group containing from 8 to 20 carbon atoms with from 2 to 10 moles of ethylene oxide per mole of alcohol.

Suitable alkylpolysaccharides for use herein are disclosed in U.S. Pat. No. 4,565,647 to Llenado, having a hydrophobic group containing from 6 to 30 carbon atoms and a polysaccharide, e.g., a polyglycoside, hydrophilic group containing from 1.3 to 10 saccharide units. Alkylpolyglycosides may have the formula: $R^2O(C_nH_{2n}O)_t(\text{glycosyl})_x$ wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl may be derived from glucose.

Suitable amphoteric surfactants for use herein include the amine oxide surfactants and the alkyl amphocarboxylic acids. Suitable amine oxides include those compounds having the formula $R^3(OR^4)_xNO(R^5)_2$ wherein $R^3$ is selected from an alkyl, hydroxyalkyl, acylamidopropyl and alkylphenyl group, or mixtures thereof, containing from 8 to 26 carbon atoms; $R^4$ is an alkylene or hydroxyalkylene group containing from 2 to 3 carbon atoms, or mixtures thereof, x is from 0 to 5, preferably from 0 to 3; and each $R^5$ is an alkyl or hydroxyalkyl group containing from 1 to 3, or a polyethylene oxide group containing from 1 to 3 ethylene oxide groups. Suitable amine oxides are C10-C18 alkyl dimethylamine oxide, and C10-18 acylamido alkyl dimethylamine oxide. A suitable example of an alkyl amphodicarboxylic acid is Miranol™ C2M Conc. manufactured by Miranol, Inc., Dayton, N.J.

Zwitterionic surfactants can also be incorporated into the cleaning compositions. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwittenionic surfactants for use herein.

Suitable cationic surfactants to be used herein include the quaternary ammonium surfactants. The quaternary ammonium surfactant may be a mono C6-C16, or a C6-C10 N-alkyl or alkenyl ammonium surfactant wherein the remaining N positions are substituted by methyl, hydroxyethyl or hydroxypropyl groups. Suitable are also the monoalkoxylated and bis-alkoxylated amine surfactants.

Solvent

Suitable organic solvents include, but are not limited to, $C_{1-6}$ alkanols, $C_{1-6}$ diols, $C_{1-10}$ alkyl ethers of alkylene glycols, $C_{3-24}$ alkylene glycol ethers, polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and pyrrolidones. Water insoluble solvents such as isoparafinic hydrocarbons, mineral spirits, alkylaromatics, terpenoids, terpenoid derivatives, terpenes, and terpenes derivatives can be mixed with a water-soluble solvent when employed. The solvents can be present at a level of from 0.001% to 10%, or from 1% to 5% by weight.

Additional Adjuncts

The cleaning compositions optionally contain one or more of the following adjuncts: stain and soil repellants, lubricants, odor control agents, perfumes, fragrances and fragrance release agents, and bleaching agents. Other adjuncts include, but are not limited to, acids, electrolytes, dyes and/or colorants, solubilizing materials, stabilizers, thickeners, defoamers, hydrotropes, cloud point modifiers, preservatives, and other polymers. The solubilizing materials, when used, include, but are not limited to, hydrotropes (e.g. water soluble salts of low molecular weight organic acids such as the sodium and/or potassium salts of toluene, cumene, and xylene sulfonic acid). The acids, when used, include, but are not limited to, organic hydroxy acids, citric acids, keto acid, and the like. Electrolytes, when used, include, calcium, sodium and potassium chloride. Thickeners, when used, include, but are not limited to, polyacrylic acid, xanthan gum, calcium carbonate, aluminum oxide, alginates, guar gum, clays, methyl, ethyl, and/or propyl hydroxycelluloses. Defoamers, when used, include, but are not limited to, silicones, aminosilicones, silicone blends, and/or silicone/hydrocarbon blends. Bleaching agents, when used, include, but are not limited to, peracids, hypohalite sources, hydrogen peroxide, and/or sources of hydrogen peroxide. Preservatives, when used, include, but are not limited to, mildewstat or bacteriostat, methyl, ethyl and propyl parabens, short chain organic acids (e.g. acetic, lactic and/or glycolic acids), bisguanidine compounds (e.g. Dantagard and/or Glydant) and/or short chain alcohols (e.g. ethanol and/or IPA).

pH Control Agents

The cleaning composition may include a builder or buffer, which increase the effectiveness of the surfactant. The builder or buffer can also function as a softener and/or a sequestering agent in the cleaning composition. A variety of builders or buffers can be used and they include, but are not limited to, phosphate-silicate compounds, zeolites, alkali metal, ammonium and substituted ammonium polyacetates, trialkali salts of nitrilotriacetic acid, carboxylates, polycarboxylates, carbonates, bicarbonates, polyphosphates, aminopolycarboxylates, polyhydroxysulfonates, and starch derivatives. Useful inorganic buffers/alkalinity sources include ammonia, the alkali metal carbonates and alkali metal phosphates, e.g., sodium carbonate, sodium polyphosphate. For additional buffers see WO 95/07971, which is incorporated herein by reference. Other suitable pH adjusting agents include sodium or potassium hydroxide. When employed, the builder or buffer comprises from about 0.001% to about 50% of the cleaning composition.

Effervescence

The cleaning composition may comprise materials that effervesce when combined with water. The materials may be within a water-soluble, water-insoluble, or water-dispersible pouch to slow the effervescent action or to protect the composition from premature hydration. The materials may comprise a polymeric agent to slow the effervescence. One component of the effervescent materials may be an acidic material. Suitable for this purpose are any acids present in dry solid form. Suitable for this purpose are C2-20 organic mono- and poly-carboxylic acids such as alpha- and beta-hydroxycarboxylic acids; C2-20 organophosphorus acids such as phytic acid; C2-20 organosulfur acids such as toluene sulfonic acid; and peroxides such as hydrogen peroxide or materials that generate hydrogen peroxide in solution. Typical hydroxycarboxylic acids include adipic, glutaric, succinic, tartaric, malic, maleic, lactic, salicylic and citric acids as well as acid forming lactones such as gluconolactone and gluccrolactone. A suitable acid is citric acid. Also suitable as acid material may be encapsulated acids. Typical encapsulating material may include water-soluble synthetic or natural polymers such as polyacrylates (e.g. encapsulating polyacrylic acid), cellulosic gums, polyurethane and polyoxyalkylene polymers. By the term "acid" is meant any substance which when dissolved in deionized water at 1% concentration will have a pH of less than 7. These acids may also have a pH of less than 6.5 or less than 5. These acids may be at 25° C. in solid form, i.e. having melting points greater than 25° C. Concentrations of the acid should range from about 0.5 to about 80%, or from about 10 to about 65%, or from about 20 to about 45% by weight of the total composition.

Another component of the effervescent materials may be a alkaline material. The alkaline material may a substance that can generate a gas such as carbon dioxide, nitrogen or oxygen, i.e. effervesce, when contacted with water and the acidic material. Suitable alkaline materials are anhydrous salts of carbonates and bicarbonates, alkaline peroxides (e.g. sodium perborate and sodium percarbonate) and azides (e.g. sodium azide). An example of the alkaline material is sodium or potassium bicarbonate. Amounts of the alkaline material may range from about 1 to about 80%, or from about 5 to about 49%, or from about 15 to about 40%, or from about 25 to about 35% by weight of the total composition.

Pine Oil, Terpene Derivatives and Essential Oils

Compositions according to the invention may comprise pine oil, terpene derivatives and/or essential oils. Pine oil, terpene derivatives and essential oils are used primarily for cleaning efficacy. They may also provide some antimicrobial efficacy and deodorizing properties. Pine oil, terpene derivatives and essential oils may be present in the compositions in amounts of up to about 10% by weight, or in amounts of 0.01% to 1% by weight.

Essential oils include, but are not limited to, those obtained from thyme, lemongrass, citrus, lemons, oranges, anise, clove, aniseed, pine, cinnamon, geranium, roses, mint, lavender, citronella, eucalyptus, peppermint, camphor, sandalwood, rosmarin, vervain, fleagrass, lemongrass, ratanhiae, cedar and mixtures thereof. Preferred essential oils to be used herein are thyme oil, clove oil, cinnamon oil, geranium oil, eucalyptus oil, peppermint oil, mint oil or mixtures thereof.

Actives of essential oils to be used herein include, but are not limited to, thymol (present for example in thyme), eugenol (present for example in cinnamon and clove), menthol (present for example in mint), geraniol (present for example in geranium and rose), verbenone (present for example in vervain), eucalyptol and pinocarvone (present in eucalyptus), cedrol (present for example in cedar), anethol (present for example in anise), carvacrol, hinokitiol, berberine, ferulic acid, cinnamic acid, methyl salycilic acid, methyl salycilate, terpineol and mixtures thereof. Preferred actives of essential oils to be used herein are thymol, eugenol, verbenone, eucalyptol, terpineol, cinnamic acid, methyl salycilic acid, citric acid and/or geraniol.

Polymers

In suitable embodiments of the invention, polymeric material that improves the hydrophilicity of the surface being treated is incorporated into the present compositions. The increase in hydrophilicity provides improved final appearance by providing "sheeting" of the water from the surface and/or spreading of the water on the surface, and this effect is preferably seen when the surface is rewetted and even when subsequently dried after the rewetting. Polymer substantivity is beneficial as it prolongs the sheeting and cleaning benefits. Another important feature of suitable polymers is lack of visible residue upon drying. In suitable embodiments, the polymer comprises 0.001 to 5%, or 0.01 to 1%, or 0.1 to 0.5% of the cleaning composition.

In general, the aqueous polymer containing composition may comprise a water-soluble or water dispersible polymer. The hydrophilic polymers preferably are attracted to surfaces and are absorbed thereto without covalent bonds. Examples of suitable polymers include the polymers and co-polymers of N,N dimethyl acrylamide, acrylamide, and certain monomers containing quaternary ammonium groups or amphoteric groups that favor substantivity to surfaces, along with co-monomers that favor adsorption of water, such as, for example, acrylic acid and other acrylate salts, sulfonates, betaines, and ethylene oxides. Other suitable polymers are described in U.S. Pat. App. 2003/0216281 to DeLeo et al.

Nanoparticles

Nanoparticles, defined as particles with diameters of about 400 nm or less, are technologically significant, since they are utilized to fabricate structures, coatings, and devices that have novel and useful properties due to the very small dimensions of their particulate constituents. "Non-photoactive" nanoparticles do not use UV or visible light to produce the desired effects. Nanoparticles can have many different particle shapes. Shapes of nanoparticles can include, but are not limited to spherical, parallelpiped-shaped, tube shaped, and disc or plate shaped.

Nanoparticles with particle sizes ranging from about 2 nm to about 400 nm can be economically produced. Particle size distributions of the nanoparticles may fall anywhere within the range from about 1 nm, or less, to less than about 400 nm, alternatively from about 2 nm to less than about 100 nm, and alternatively from about 2 nm to less than about 50 nm. For example, a layer synthetic silicate can have a mean particle size of about 25 nanometers while its particle size distribution can generally vary between about 10 nm to about 40 nm. Alternatively, nanoparticles can also include crystalline or amorphous particles with a particle size from about 1, or less, to about 100 nanometers, alternatively from about 2 to about 50 nanometers. Nanotubes can include structures up to 1 centimeter long, alternatively with a particle size from about 1 nanometer, or less, to about 50 nanometers. Nanoparticles can be present from 0.01 to 10%.

Inorganic nanoparticles generally exist as oxides, silicates, carbonates and hydroxides. These nanoparticles are generally hydrophilic. Some layered clay minerals and inorganic metal oxides can be examples of nanoparticles. The layered clay minerals suitable for use in the coating composition include those in the geological classes of the smectites, the kaolins, the illites, the chlorites, the attapulgites and the mixed layer clays. Smectites include montmorillonite, bentonite, pyrophyllite, hectorite, saponite, sauconite, nontronite, talc, beidellite, volchonskoite and vermiculite. Kaolins include kaolinite, dickite, nacrite, antigorite, anauxite, halloysite, indellite and chrysotile. Illites include bravaisite, muscovite, paragonite, phlogopite and biotite. Chlorites include corrensite, penninite, donbassite, sudoite, pennine and clinochlore. Attapulgites include sepiolite and polygorskyte. Mixed layer clays include allevardite and vermiculitebiotite. Variants and isomorphic substitutions of these layered clay minerals offer unique applications.

Fragrance

Compositions of the present invention may comprise from about 0.1% to about 20% by weight of the fragrance oil. Compositions of the present invention may comprise from about 1% to about 10% by weight of the fragrance oil. Compositions of the present invention may comprise greater than 1% fragrance oil. Compositions of the present invention may comprise greater than 4% fragrance oil.

Water

When the composition is an aqueous composition, water can be, along with the solvent, a predominant ingredient. The water can be present at a level of less than 99.9%, or less than about 99%, or less than about 98%. Deionized water is preferred. Where the cleaning composition is concentrated, the water may be present in the composition at a concentration of less than about 85 wt. %.

Package

The packaging for the cleaning implement and cleaning substrates can be less than 15 inches in width and 10.5 inches in height. The packaging for the cleaning substrates can be from 5-10 inches in width and less than 10.5 inches in height. Suitable packaging includes an individual or multiple (containing several up to 10 pads) flexible pouch, such as one based on polyethylene. The pouch can be laminated, for instance with polyethylene terephthalate. The pouch can include a zipper or slider to allow the consumer easy access to the cleaning substrates. Suitable packaging includes a thermoformed clamshell, for example out of polypropylene with a cardboard sleeve. Suitable packaging includes a tub with a lid, for example from thermoformed or injection molded polyethylene.

Method of Use

The cleaning substrates can be used for cleaning, disinfectancy, or sanitization on inanimate, household surfaces, including toilets, floors, counter tops, furniture, windows, walls, and automobiles. Other surfaces include stainless steel, chrome, and shower enclosures. The cleaning pad can be packaged individually or together in canisters, tubs, etc. The cleaning substrate can be used as part of a cleaning implement attached to a tool or motorized tool, such as one having a handle. Examples of tools using a cleaning substrate include U.S. Pat. No. 6,611,986 to Seals, PCT App. WO00/71012 to Belt et al., U.S. Pat. App. 2002/0129835 to Pieroni and Foley, and PCT App. WO00/27271 to Policicchio et al.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

We claim:

1. A cleaning tool comprising:

a. an elongated handle; and b. a cleaning head comprising:

i. a fitment including a base having a bottom surface;

ii. a cleaning substrate having top and bottom surfaces, the substrate top surface being secured to the fitment bottom surface; and c. the fitment having a rod-like structure extending from and substantially perpendicular to an upper surface of the base for attachment to the handle and having a fitment edge attached to said cleaning substrate;

d. wherein the fitment is rotationally attached to the handle;

e. the handle being coupled to an engagement member such that an axis of the engagement member and the longitudinal axis of the handle are generally aligned and wherein this alignment of the two axes is fixed during use of the cleaning tool; and f. the cleaning head being adapted to be attached in any orientation about an axis coincident the rod-like structure and the handle axis.

2. The cleaning tool of claim 1, wherein a cleaning composition is impregnated in said cleaning substrate.

3. The cleaning tool of claim 1, wherein said cleaning substrate has a cleaning face in the shape of a regular polygon.

4. The cleaning tool of claim 1, wherein said cleaning substrate has a cleaning face in the shape of a regular heptagon.

5. The cleaning tool of claim 1, wherein said cleaning substrate has a cleaning face in the shape of a regular hexagon.

6. The cleaning tool of claim 1, wherein said cleaning substrate has a cleaning face in the shape of a regular pentagon.

7. The cleaning tool of claim 1, wherein said cleaning substrate has a cleaning face in the shape of a square.

8. The cleaning tool of claim 1, wherein said cleaning substrate has a cleaning face in the shape of an equilateral triangular.

9. The cleaning tool of claim 1, wherein said cleaning head is used to clean a surface selected from the group consisting of a window, a shower, a toilet, an automobile, and combinations thereof.

10. The cleaning tool of claim 1, wherein said cleaning head is used to clean a toilet.

11. The cleaning tool of claim 1, wherein said cleaning substrate has a cleaning face in the shape of a polygon.

12. A cleaning tool comprising:

a. an elongated handle; and b. a cleaning head comprising:

i. a fitment including a base having a bottom surface;

ii. a cleaning substrate having top and bottom surfaces, the substrate top surface being secured to the fitment bottom surface; and iii. the fitment having an integral engagement member extending from and substantially perpendicular to an upper surface of the base;

c. the handle being coupled to the engagement member such that an axis of the engagement member and the longitudinal axis of the handle are generally aligned and wherein this alignment of the two axes is fixed during the use of the cleaning tool;

d. the cleaning head being adapted to rotationally articulate relative to the handle about an axis coincident with the engagement member and handle axis.

13. The cleaning tool of claim 12, wherein said fitment comprises a thermoplastic material.

14. The cleaning tool of claim 13, wherein said thermoplastic material is polyethylene.

15. The cleaning tool of claim 12, wherein said fitment edge has less than 0.1 mm thickness.

16. The cleaning tool of claim 12, wherein said cleaning tool is used to clean a surface selected from the group consisting of a window, a shower, a toilet, an automobile, and combinations thereof.

17. The cleaning tool of claim 12, wherein said cleaning tool is used to clean a toilet.

* * * * *